US011566806B2

(12) United States Patent
Dempsey

(10) Patent No.: US 11,566,806 B2
(45) Date of Patent: Jan. 31, 2023

(54) HUMIDITY ANALYTICS

(71) Applicant: Carrier Corporation, Palm Beach Gardens, FL (US)

(72) Inventor: Daniel J. Dempsey, Carmel, IN (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 390 days.

(21) Appl. No.: 16/833,939

(22) Filed: Mar. 30, 2020

(65) Prior Publication Data

US 2020/0309397 A1 Oct. 1, 2020

Related U.S. Application Data

(60) Provisional application No. 62/827,251, filed on Apr. 1, 2019.

(51) Int. Cl.

| | |
|---|---|
| ***F24F 11/49*** | (2018.01) |
| ***F24F 11/48*** | (2018.01) |
| *F24F 110/22* | (2018.01) |

(52) U.S. Cl.

CPC ..... *F24F 11/49* (2018.01); *F24F 11/48* (2018.01); *F24F 2110/22* (2018.01)

(58) Field of Classification Search

None

See application file for complete search history.

(56) References Cited

U.S. PATENT DOCUMENTS

| | | | | |
|---|---|---|---|---|
| 6,269,650 | B1 * | 8/2001 | Shaw | F24F 11/83 236/44 C |
| 2018/0142909 | A1 * | 5/2018 | Kraft | F24F 3/14 |
| 2018/0342006 | A1 * | 11/2018 | Biernath | G06Q 30/0631 |
| 2018/0342118 | A1 * | 11/2018 | Suzuki | B60H 3/02 |
| 2019/0293311 | A1 * | 9/2019 | Kohashi | F24F 11/65 |
| 2021/0222905 | A1 * | 7/2021 | Morioka | F24F 11/86 |

* cited by examiner

*Primary Examiner* — Nathan L Laughlin

(74) *Attorney, Agent, or Firm* — Cantor Colburn LLP

(57) ABSTRACT

Provided are embodiments that include a system for performing humidity analytics. The system includes an air conditioning system, and one or more sensors operably coupled to the air conditioning system, and a computing server including an HVAC analytics engine operably coupled to the air conditioning system, the HVAC analytics engine configured to actively monitor the air conditioning system based at least in part on data from the one or more sensors over a period of time, and a processor. The processor is configured to monitor moisture characteristics, receive inputs from the one or more sensors to perform a humidity calculation, perform the humidity calculation based on the received inputs from the one or more sensors, and track the humidity calculation over a period of time. Embodiments also include methods for performing humidity analytics.

12 Claims, 4 Drawing Sheets

HUMIDITY ANALYTICS

CROSS-REFERENCE TO RELATED APPLICATIONS

This application claims the benefit of U.S. Patent Application Ser. No. 62/827,251, filed Apr. 1, 2019, the contents of which is incorporated by reference herein in its entirety.

BACKGROUND

The present disclosure relates generally to the tracking of moisture in a home, and more specifically to using humidity analytics for performing diagnostics.

Heating, ventilation, and air conditioning (HVAC) systems are used for maintaining the air for a variety of environments. For example, HVAC systems are included in residential buildings such as homes, apartments, and hotels. HVAC systems can also be included in vehicles such as cars, airplanes, and ships. HVAC systems can include a number of equipment such as compressors, evaporators, condensers, fans, etc. Due to the complexity of the system each portion of the HVAC system can require periodic maintenance to ensure optimal performance. There may be a need to obtain insights into the HVAC system to more effectively diagnose moisture management problems resulting in occupant discomfort.

BRIEF SUMMARY

According to an embodiment, a system for performing humidity analytics is provided. The system includes an air conditioning system, one or more sensors operably coupled to the air conditioning system, a computing server including an HVAC analytics engine operably coupled to the air conditioning system, the HVAC analytics engine configured to actively monitor the air conditioning system based at least in part on data from the one or more sensors over a period of time, and a processor. The processor is configured to monitor moisture characteristics, receive inputs from the one or more sensors to perform a humidity calculation, perform the humidity calculation based on the received inputs from the one or more sensors, and track the humidity calculation over a period of time.

In addition to one or more of the features described herein, or as an alternative, further embodiments include moisture characteristics that include HVAC latent capacity data, moisture load information, moisture factors, system run-time, and air and moisture diffusion/leakage information.

In addition to one or more of the features described herein, or as an alternative, further embodiments include moisture characteristics that are calculated as time-series data based on an indoor humidity value, an outdoor humidity value, and moisture removal/addition capacity of the air conditioning system.

In addition to one or more of the features described herein, or as an alternative, further embodiments include moisture load information that is based on a humidity differential between an indoor humidity of a targeted area and an outside humidity, a humidification factor, and an internal moisture load.

In addition to one or more of the features described herein, or as an alternative, further embodiments include moisture load information that is determined in response to calculating a derivative of indoor humidity versus time.

In addition to one or more of the features described herein, or as an alternative, further embodiments include a derivative that is calculated according to the following Equation:

$$\frac{dW_{room}}{dt} = k1 * [W_{room} - W_{OA}] + k_2 * Cap + C;$$

wherein W=absolute moisture content; K1=air/moisture diffusion/leakage; C=internal latent loads; K2=de/humidification factor; Cap—de/humidification capacity of the air conditioning system.

In addition to one or more of the features described herein, or as an alternative, further embodiments include a processor that is configured to compare a current value for moisture diffusion/air leakage to a historical value for moisture diffusion/air leakage, determine a leak based at least in part on the comparison, and provide an indication of the leakage to a terminal device.

In addition to one or more of the features described herein, or as an alternative, further embodiments include a processor that is configured to compare a current value for internal moisture loads to a historical value for internal moisture load, determine abnormal internal moisture load based at least in part on the comparison, and provide an indication of the abnormal internal moisture load to a terminal device.

In addition to one or more of the features described herein, or as an alternative, further embodiments include a processor that is configured to compare a current value of the humidification factor to a historical value for the humidification factor, determine an abnormal humidification factor based at least in part on the comparison, and provide an indication of the abnormal humidification factor to a terminal device.

According to an embodiment, a method for performing house humidity analytics is provided. The method includes monitoring moisture characteristics, receiving inputs from one or more sensors to perform a humidity calculation, performing the humidity calculation based on the received inputs from the one or more sensors, and tracking the humidity calculation over a period of time.

In addition to one or more of the features described herein, or as an alternative, further embodiments include moisture characteristics that include HVAC capacity data, moisture load information, humidification factors, and air and moisture diffusion/leakage information.

In addition to one or more of the features described herein, or as an alternative, further embodiments include moisture characteristics that are calculated as time-series data based on an indoor humidity value, an outdoor humidity value, and moisture removal/addition capacity of an air conditioning system.

In addition to one or more of the features described herein, or as an alternative, further embodiments include moisture load information that is based on a humidity differential between an indoor humidity of a targeted area and an outside humidity, a humidification factor, and an internal moisture load.

In addition to one or more of the features described herein, or as an alternative, further embodiments include moisture load information that is determined in response to calculating a derivative of indoor humidity versus time.

In addition to one or more of the features described herein, or as an alternative, further embodiments include the derivative is calculated according to the following Equation:

$$\frac{dw_{room}}{dt} = k1 * [W_{room} - W_{OA}] + k_2 * Cap + C;$$

wherein W=absolute moisture content; K1=air/moisture diffusion/leakage; C=internal latent loads; K2=de/humidification factor; Cap—de/humidification capacity of an air conditioning system.

In addition to one or more of the features described herein, or as an alternative, further embodiments include a processor that is configured to compare a current value for moisture diffusion/air leakage to a historical value for moisture diffusion/air leakage, determining a leak based at least in part on the comparison, and providing an indication of the leakage to a terminal device.

In addition to one or more of the features described herein, or as an alternative, further embodiments include a processor that is configured to compare a current value for internal moisture loads to a historical value for internal moisture load, determining abnormal internal moisture load based at least in part on the comparison, and providing an indication of the abnormal internal moisture load to a terminal device.

In addition to one or more of the features described herein, or as an alternative, further embodiments include a processor that is configured to compare a current value of the humidification factor to a historical value for the humidification factor, determining an abnormal humidification factor based at least in part on the comparison, and providing an indication of the abnormal humidification factor to a terminal device.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The present disclosure is illustrated by way of example and not limited in the accompanying figures in which like reference numerals indicate similar elements.

DETAILED DESCRIPTION

Often times, the air conditioning system is assumed to be the cause of an issue associated with high humidity, when in fact, it can be due to air leaks in the house because of voids in the thermal envelope, high internal loads due to occupant behavior or ground water, or excessive ventilation airflow. There are also times when the air conditioning system can contribute to high humidity, either through oversizing of the system or operating at very high airflow. In addition, moisture can enter a building through a diffusion process when building materials are dried at the end of construction (such as water in concrete slabs or lumber that has not dried). The techniques described herein provide the ability to track the moisture content over a period of time so as to define whether the source of high or low humidity is from a house air leakage, outdoor conditions, high internal loads, or poor humidity control by the HVAC system. These insights can be useful to a technician that will perform service or respond to a maintenance request for the HVAC system.

Figure 1:
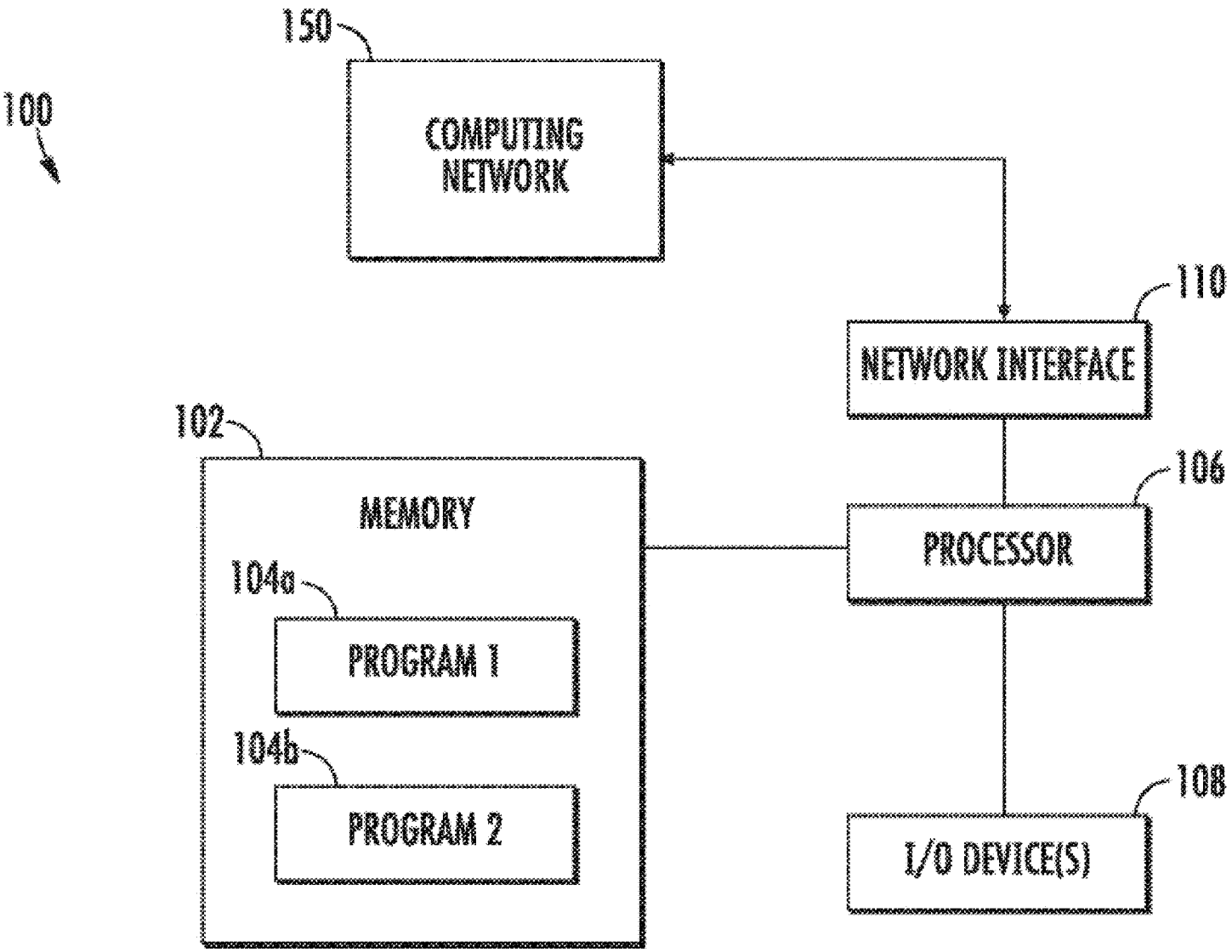
FIG. 1 depicts a schematic illustration of a system that may employ various embodiments of the present disclosure.

With reference now to FIG. 1, a computing system 100 capable of performing one or more embodiments is illustrated. The computing system 100 includes a memory 102 and an electronic hardware processor or controller 106. The memory 102 stores various instructions algorithms which are executable by the controller 106. The memory 102 can also store set operating schedules, parameters and historical data obtained from the computing network 150, the controller 106 and/or the 110 devices 108. The executable instructions can be stored or organized in any manner and at any level of abstraction, such as in connection with one or more processes, routines, procedures, methods, functions, etc. As an example, at least a portion of the instructions are shown in FIG. 1 as being associated with a first program 104*a* and a second program 104*b*. The programs 104*a* and 104*b* can include HVAC control programs and/or scheduling software that capable of automatically controlling an HVAC system.

The processor or electronic controller 106 can be included in a computing system that is installed in a computing network, a mobile computing device, or a local control system such as, for example, an HVAC control system. The computing network can include a cloud-based computing network including one or more cloud-computing servers. The controller 106 electrically communicates with the memory 102 via one or more input/output (110) devices 108. In some embodiments, the 110 device(s) 108 may include one or more of a keyboard or keypad, a touchscreen or touch panel, a display screen, a microphone, a speaker, a mouse, a button, a remote control, a joystick, a printer, a telephone or mobile device (e.g., a smartphone), etc. The 110 device(s) 108 may be configured to provide an interface such as a thermostat interface, for example, to allow a user to interact with the system 100.

The computing system 100 further includes a network interface 110 capable of electrical communication with a computing network 150. The computing network 150 can be implemented as a local on-site network and/or a cloud computing network. The network interface 110 includes any communication device (e.g., a modem, wireless network adapter, etc.) that operates according to a network protocol (e.g., Wi-Fi, Ethernet, satellite, cable communications, etc.) which establishes a wired and/or wireless communication with the computing network 150.

The computing system 100 is illustrative as an example. In some embodiments, one or more of the entities may be optional. In some embodiments, additional entities not shown may be included. For example, in some embodiments the computing system 100 may be associated with one or more networks, such as one or more computer or telephone networks. In some embodiments, the entities may be arranged or organized in a manner different from what is shown in FIG. 1.

Figure 2:
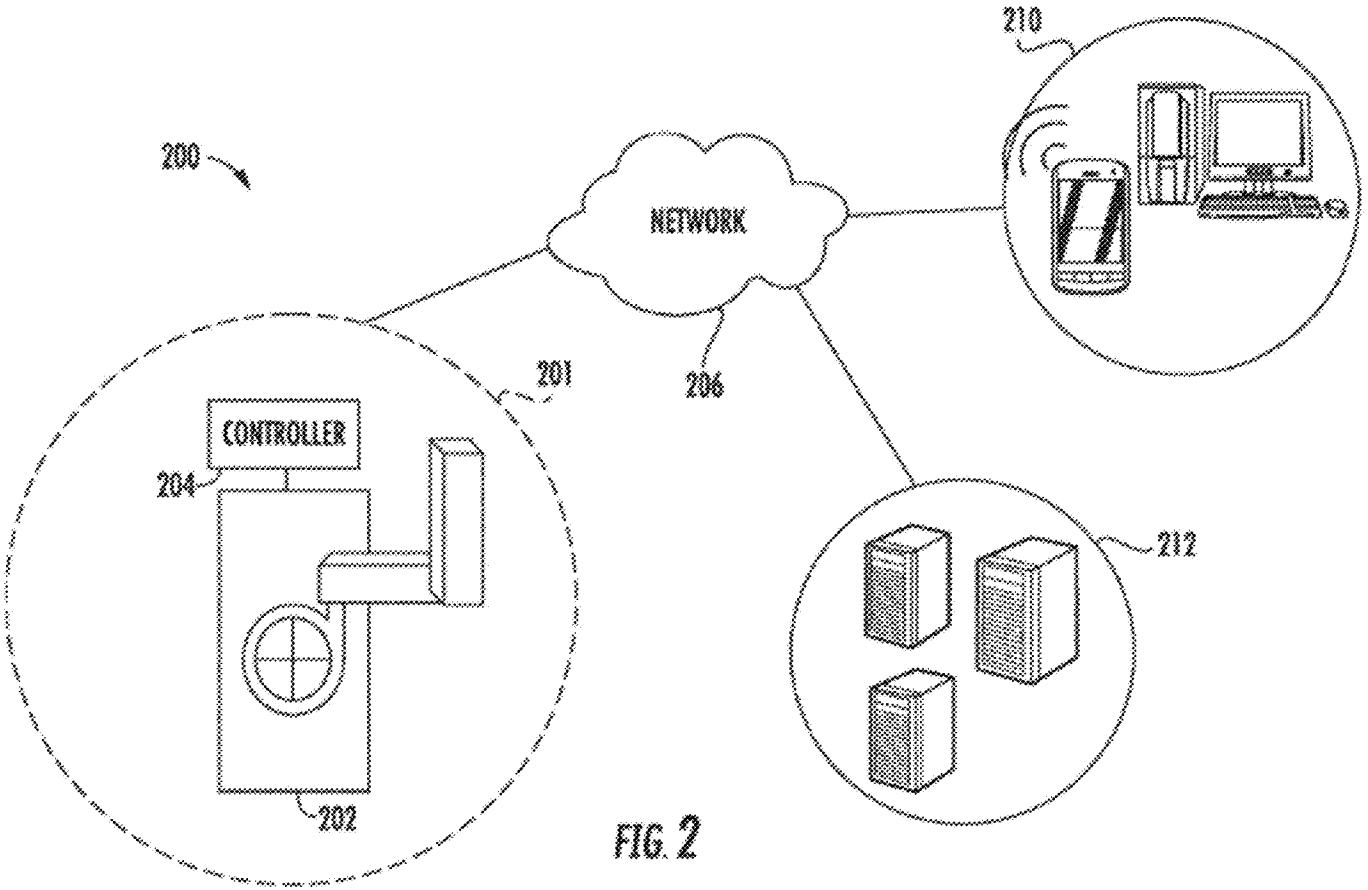
FIG. 2 depicts a network-based HVAC system in accordance with one or more embodiments.

Turning now to FIG. 2, a block diagram illustrates an HVAC control network 200 in accordance with one or more non-limiting embodiments. The HVAC control network 200 is in signal communication with an HVAC system 201 that includes one or more HVAC units 202. Although a single HVAC unit 202 is illustrated, it should be appreciated that the HVAC system 201 can include additional HVAC units. For example, the HVAC unit 202 may be included in a group of HVAC units. An HVAC group may include additional HVAC units (not shown) located at different areas of a building or house, or even in a different home.

The HVAC unit 202 is in signal communication with one or more electronic controllers 204. It should be appreciated that in addition to the HVAC unit 202, other units such as but not limited to air conditioners, stand-alone dehumidifiers, humidification systems, and ventilations systems can be included in the HVAC control network 200. Any device that can add or remove moisture within a structure such as a home can be included. The controller 204 includes a digital thermostat, for example, configured to control operation of the HVAC unit 202. Although one controller 204 is illustrated, it should be appreciated that multiple controllers can be located remotely from one another. Each controller 204 can control the HVAC unit 202.

The controller 204 can perform various functions including, but not limited to, switching on and off the HVAC unit 202, selecting a mode (e.g., heating mode, cooling mode, etc.) of the HVAC unit 202, setting a desired room temperature or minimum/maximum humidity at which to operate the HVAC unit 202, and setting operating schedules at which to operate the HVAC unit 202. The controller 204 also includes a memory capable storing temperature set points, operating schedules and historical data such as for example, historical run-time data and historical temperature recovery data. The controller 204 is also in signal communication with one or more sensors configured to detect and monitor various conditions such as, for example, room temperatures and humidity. In this manner, the controller 204 can actively control the HVAC unit 202 to achieve and/or maintain a room temperature set point value and/or set according to an operating schedule. In addition, the controller 204 is also coupled to one or more or more sensors that are configured to detect humidity both indoors and outdoors of a monitored space and maintain a humidity level within predefined limits.

One or more of the controllers 204 may be in signal communication with a network 206. In some embodiments, the network 206 may include a data network, a computer network, a telephone network, a cloud network, etc. The network 206 can also be implemented in connection additional cloud computing platforms such as a weather service to obtain additional data that can be used during processing in accordance with the techniques described herein. The network 206 may be in signal communication with one or more electronic user terminal devices 210. The terminal devices 210 include, but are not limited to, a desktop computer, a laptop computer, and a mobile device (e.g., a cell phone, smartphone, smart wearable device, etc.). In some embodiments, the controller 204 may communicate with a user device 210 via the network 206. In some embodiments, the controller 204 may communicate directly with a user device 210. For instance, the controller 204 may be capable of communicating directly with the user device 210 via a short-range communication protocol such as, for example, Bluetooth.

The HVAC control network 200 may be used to schedule one or more run-time operations. For example, a user may indicate, via the electronic user terminal device 210, that they are going to be arriving at their house at a particular time. Such an indication may be provided in connection with a calendar associated with the user or the user device 210. Alternatively, the user's arrival at the house may be inferred or deduced based on the user's history. For example, global positioning system (GPS) or other location techniques may be used to obtain the user's location and time stamp. The data can be delivered from a user device 210 to the controller 204, via the network 206, such that the user's occupancy duration in the house can be determined on a daily basis. Based on the occupancy data, the controller 204 can determine (i.e., learn) the times the user enters, stays, and leaves the house. In this manner, the controller 204 can automatically control the HVAC unit 202 based on the learned occupancy data.

Thus, as described above, a controller 204 (or other computing device or entity) may leverage occupancy data to actively control the HVAC unit 202. Such scheduling may be further enhanced if exterior environmental data, e.g., from the network 206, is obtained. For example, the controller 204 is in signal communication with the network 206 and can obtain weather trends and weather forecasts stored on various servers 212. In another example, the controller is able to obtain outdoor humidity data from the network 206 that can be used by the analytics engine. In this manner, the controller 204 can automatically adjust the settings of the HVAC unit 202 to take into account weather conditions.

Figure 3:
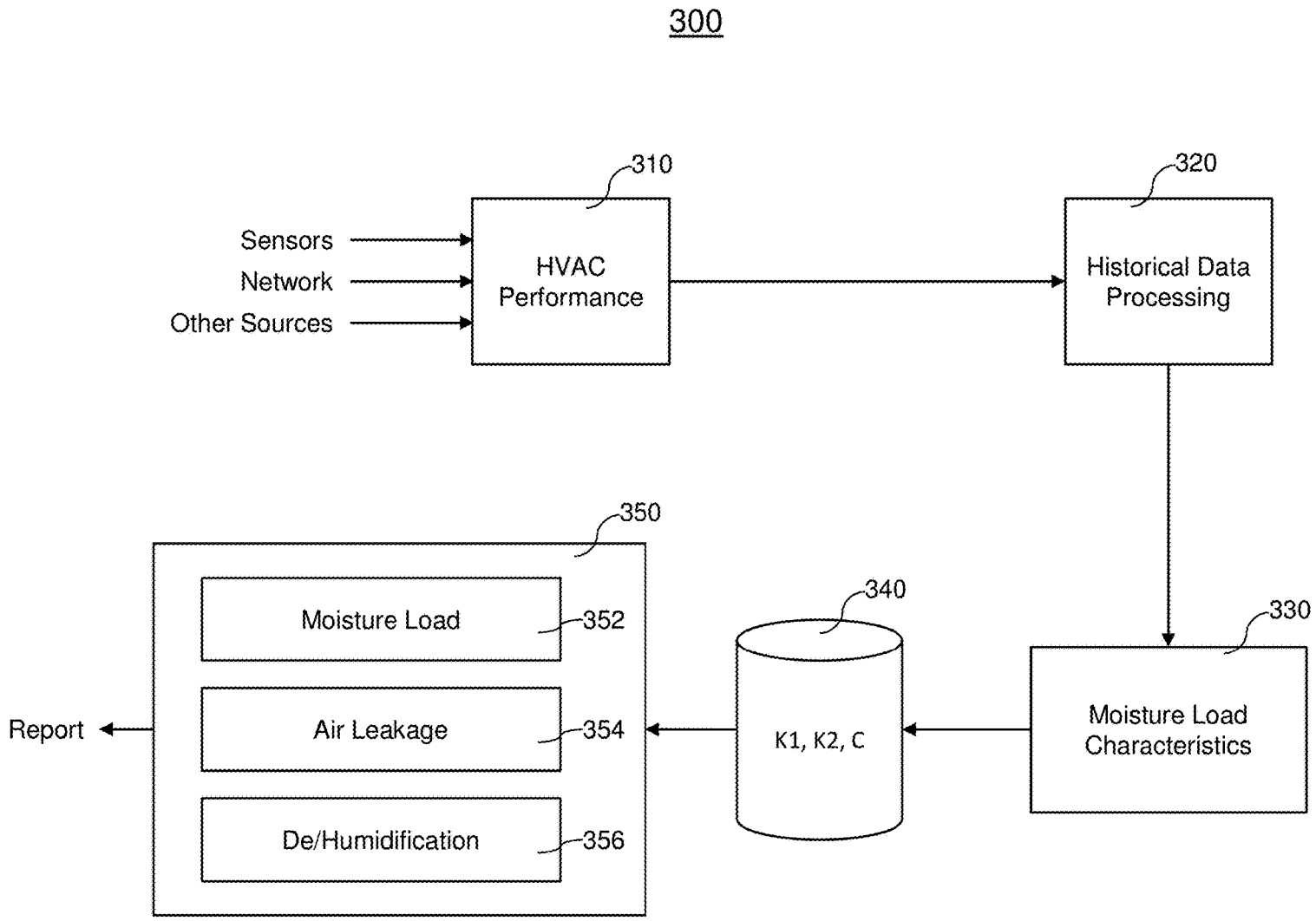
FIG. 3 depicts a network-based HVAC system in accordance with one or more embodiments.

FIG. 3 depicts an HVAC analytics engine 300 for performing humidity analytics in accordance with one or more embodiments. It should be understood that the system can be implemented in any of the systems shown in FIGS. 1 and 2. In some embodiments, the HVAC analytics engine 300 can reside within the HVAC system controller. It should also be appreciated the HVAC analytics engine 300 can also reside in any other connected device with storage such as a Wi-Fi router. As shown, FIG. 3 depicts an HVAC analytics engine 300 that includes an HVAC performance module 310 that receives data from a number of sources including but not limited to sensors, a network, and other sources. The HVAC performance module 310 is configured to perform calculations to model the capabilities of the HVAC system based on the HVAC system characteristics. For example, a system capacity (Cap) performance indicates the HVAC system's ability to increase or decrease the humidity within a defined space with respect to given conditions. Latent capacity of an air conditioner is a function of indoor unit airflow, indoor conditions (temperature and humidity), and outdoor temperature. Other performance metrics and indicators can be monitored such as operational efficiency and are not limited by the example above.

The historical data module 320 can be configured to determine historical data of the HVAC system based on the operation data that has been received. In at least one embodiment, the historical data is calculated as time-series data based on indoor humidity and temperature values, outdoor temperature and humidity values, system run-time and an HVAC capacity of the HVAC system. The historical data can serve as actively learned coefficients, which are then utilized to assist in the identification of sources humidity issues. In one or more embodiments, the learned coefficients can be used a threshold values to compare to the current or predicted values which can provide an indication as to the source of moisture within the environment or house. In some embodiments, the run-time data is used to determine the amount of moisture the HVAC system can remove based on its BTU/hour latent capacity.

The moisture load module 330 is configured to determine a moisture load characteristic for a defined area. The moisture load characteristic is based on a humidity differential (K1) between an indoor humidity and an outside humidity values, a de/humidification factor (K2), and various internal moisture loads (C). The internal loads include, but are not limited to, moisture sources such as, for example, occupant body respiration (number of occupants and level of activity), moisture output by home appliances (i.e. clothes washer), moisture resulting from plumbing, rain and groundwater leaks, evaporation from wet building materials (concrete and lumber) and increased moisture caused by cooking meals, baths, showers, etc. The moisture load characteristic can be represented as a humidity recovery rate (dW/dt). The (absolute) humidity recovery rate can be determined as a derivative of indoor humidity versus time. The humidity recovery rate can be calculated according to the following Equation:

$$\frac{dW_{room}}{dt} = k1 * [W_{room} - W_{OA}] + k_2 * Cap + C \quad \text{(Eq. 1)}$$

wherein W=Absolute moisture content; K1=moisture leakage or diffusion; C=internal latent loads; K2=de/humidification factor. The K1, K2 and C values are also referred to as the moisture factors.

In addition, the following Equations 2 and 3 can be used to determine a coast down phase and a maintain phase of the HVAC system, respectively:

$$\frac{dW_{room}}{dt} = k1 * [W_{room} - W_{OA}] + C; \quad Cap = 0 \quad \text{(Eq. 2)}$$

$$Cap = \frac{k1 * [W_{room} - W_{OA}] + C}{-k_2}; \quad \frac{dW_{room}}{dt} = 0 \quad \text{(Eq. 3)}$$

In this manner, the moisture load characteristics can be actively learned (i.e., actively monitored and stored in memory 340) by recording the indoor humidity variation rate, recording the outdoor humidity, determining a differential between the indoor humidity and the outdoor humidity, and determining the HVAC system capacity (i.e., latent cooling capacity and/or de/humidification capacity).

The humidity is tracked and the humidity trends are predicted through solving of constants in the fundamental equations that take into account the dynamic behavior over the house. These factors provide insight into the moisture load, and whether it is dues to envelope losses (ventilation airflow and air leakage), high internal loads, or poor humidity control by the HVAC system. The method described herein tracks the house moisture content to analyze the source of high or low humidity.

The possible sources of high or low humidity can be from house air leakage and outdoor conditions, high internal loads, or poor humidity control by the HVAC system. The prediction module is configured to calculate one or more predicted HVAC parameters of the HVAC system. The predicted HVAC parameters include, but are not limited to, a moisture load prediction of the area to be heated or cooled, predicted runtimes, etc. By comparing the historical values for K1, K2, and C to the current values or predicted values and indication can be provided to a source to the humidity issue. For example, a higher than normal value K1 can indicate an air or moisture leak that is affecting the indoor humidity level. A higher than normal moisture load value C can indicate moisture is being generated within the house which is increasing the indoor humidity. The K1, K2 and C values can also be used to compare to moisture flow conditions in other residences, either directly or normalized by house size, volume, age, geographic location, and so on. The techniques described herein allow for comparison of moisture factors of a given home to other homes which can be used to determine homes that have optimal moisture management performance and those that do not. That is, homes that have less of a chance of exceeding minimum/maximum humidity limits, etc. can be determined based on the comparison The HVAC analytics engine 300 is also configured to generate one or more HVAC reports. The report can include performance reports for the HVAC system. In addition, the reports can identify one or more indicators as to the source of the humidity issues such as abnormal moisture load information 352, air leakage and ventilation system information 354, or de-humidification information 356 based on comparing the current conditions to the historical conditions.

Figure 4:
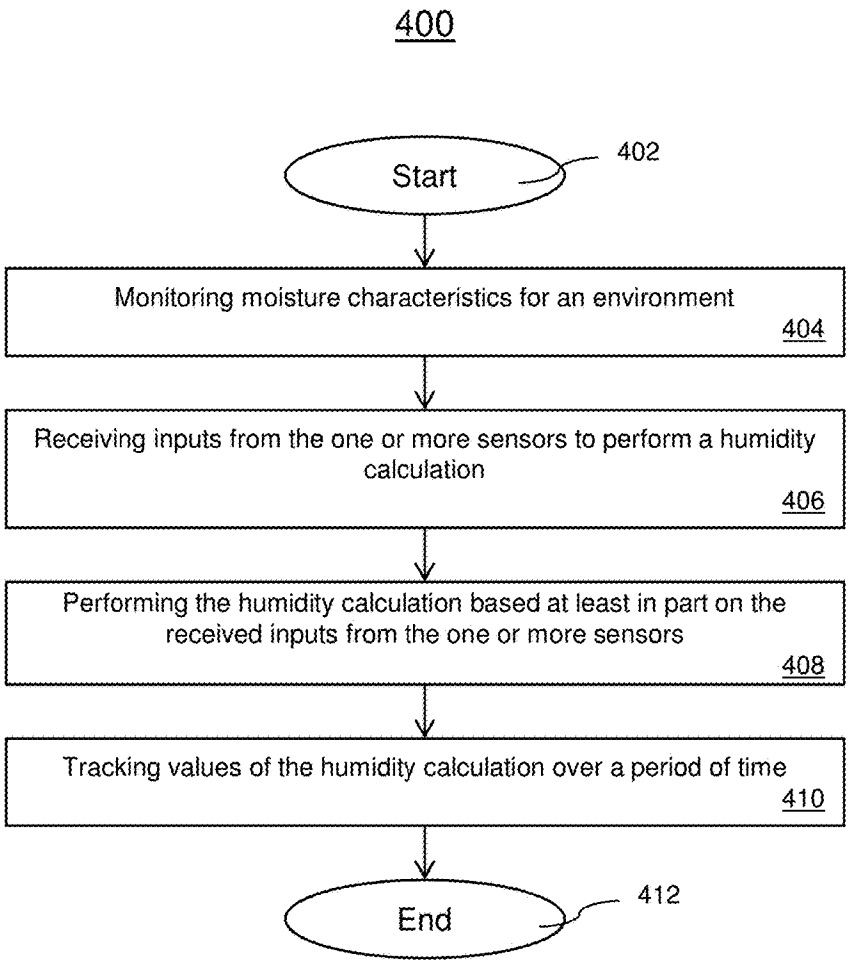
FIG. 4 depicts a flow diagram illustrating a method for operating an HVAC system in accordance with one or more embodiments.

Now referring to FIG. 4, a method 400 for performing humidity analytics is shown. In one or more embodiments, the HVAC and control system is a cloud-based system. The method 400 begins at operation 402, and continues to operation 404 and monitors humidity characteristics of an environment. In the event the humidity analytics monitors the relative humidity, the dry bulb temperature must also be monitored to compute the absolute humidity. The humidity analytics are determined by an HVAC analytics engine installed in a computing server. In at least one embodiment, the computing server is a cloud-computing server. The HVAC system configuration can be sent to the HVAC analytics engine using a terminal device (e.g., smart-phone, laptop computer, etc.), and/or by a controller (e.g., digital thermostat) in communication with the computing network. At operation 406, inputs are received from one or more sensors that are coupled to the system (or obtained via an external weather service) to perform humidity calculations. At operation 408, the humidity calculations are performed based at least in part on the received inputs from the one or more sensors. The inputs can include indoor humidity, outdoor humidity, HVAC capacity data, internal moisture load, HVAC system run-time, number of occupants, etc. Turning to operation 410, the humidity calculation values are tracked over a period of time. These values are used to determine historical operating characteristics and are compared to the current conditions or predicted conditions of the HVAC system and environment to produce the insights to be reported. In at least one embodiment, the HVAC analytics engine generates the reports and communicates the reports to a terminal device in communication with the computing network. The reports can be displayed via the terminal device such that a user is able to monitor the operating performance and energy efficiency of the HVAC system. Based on the reports, a technician can use the obtained data to more effectively diagnose moisture management problems resulting in occupant discomfort.

The method 400 ends at block 412. It should be understood that the method 400 can be performed by different operations or additional operations and is not limited by the operations provided in FIG. 4.

Technical effects of embodiments of the present disclosure can be used to provide insights for a service technician as to the cause of high or low humidity within a structure. The technical effects and benefits include providing an improvement to the technician's ability to correctly diagnose the problem and provide the customer with more robust solutions, thus reducing unnecessary equipment repairs or replacement.

As described above, embodiments can be in the form of processor-implemented processes and devices for practicing those processes, such as a processor. Embodiments can also be in the form of computer program code containing instructions embodied in tangible media, such as network cloud storage, SD cards, flash drives, floppy diskettes, CD ROMs, hard drives, or any other computer-readable storage medium, wherein, when the computer program code is loaded into and executed by a computer, the computer becomes a device for practicing the embodiments. Embodiments can also be in the form of computer program code, for example, whether stored in a storage medium, loaded into and/or executed by a computer, or transmitted over some transmission medium, loaded into and/or executed by a computer, or transmitted over some transmission medium, such as over electrical wiring or cabling, through fiber optics, or via electromagnetic radiation, wherein, when the computer program code is loaded into an executed by a computer, the computer becomes an device for practicing the embodiments. When implemented on a general-purpose microprocessor, the computer program code segments configure the microprocessor to create specific logic circuits.

The term "about" is intended to include the degree of error associated with measurement of the particular quantity and/or manufacturing tolerances based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Those of skill in the art will appreciate that various example embodiments are shown and described herein, each having certain features in the particular embodiments, but the present disclosure is not thus limited. Rather, the present disclosure can be modified to incorporate any number of variations, alterations, substitutions, combinations, subcombinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. A system for performing humidity analytics, the system comprising:

an air conditioning system;

one or more sensors operably coupled to the air conditioning system;

a computing server including an HVAC analytics engine operably coupled to the air conditioning system, the HVAC analytics engine configured to actively monitor the air conditioning system based at least in part on data from the one or more sensors over a period of time; and a processor, wherein the processor is configured to:

monitor moisture characteristics;

receive inputs from the one or more sensors to perform a humidity calculation;

perform the humidity calculation based on the received inputs from the one or more sensors and the moisture characteristics; and track the humidity calculation over a period of time;

wherein the monitored moisture characteristics include HVAC latent capacity data, moisture load information, moisture factors, and air and moisture diffusion/leakage information;

wherein the moisture load information is based on a humidity differential between an indoor humidity of a targeted area and an outside humidity, a humidification factor, and an internal moisture load;

wherein the moisture load information is determined in response to calculating a derivative of indoor humidity versus time.

2. The system of claim 1, wherein the moisture characteristics are calculated as time-series data based on an indoor humidity value, an outdoor humidity value, and moisture removal/addition capacity of the air conditioning system.

3. The system of claim 1, wherein the derivative is calculated according to the following Equation:

$$\frac{dW_{room}}{dt} = k1 * [W_{room} - W_{OA}] + k_2 * Cap + C;$$

wherein W=absolute moisture content; K1=air/moisture diffusion/leakage; C=internal latent loads; K2=de/humidification factor; Cap—de/humidification capacity of the air conditioning system.

4. The system of claim 3, wherein the processor is configured to compare a current value for moisture diffusion/air leakage to a historical value for moisture diffusion/air leakage;

determine a leak based at least in part on the comparison; and provide an indication of the leakage to a terminal device.

5. The system of claim 3, wherein the processor is configured to compare a current value for internal moisture loads to a historical value for internal moisture load;

determine abnormal internal moisture load based at least in part on the comparison; and provide an indication of the abnormal internal moisture load to a terminal device.

6. The system of claim 3, wherein the processor is configured to compare a current value of the humidification factor to a historical value for the humidification factor;

determine an abnormal humidification factor based at least in part on the comparison; and provide an indication of the abnormal humidification factor to a terminal device.

7. A method for performing house humidity analytics, the method comprising:

monitoring moisture characteristics;

receiving inputs from one or more sensors to perform a humidity calculation;

performing the humidity calculation based on the received inputs from the one or more sensors and the moisture characteristics and the moisture characteristics; and tracking the humidity calculation over a period of time;

wherein the monitored moisture characteristics include HVAC capacity data, moisture load information, humidification factors, and air and moisture diffusion/leakage information;

wherein the moisture load information is based on a humidity differential between an indoor humidity of a targeted area and an outside humidity, a humidification factor, and an internal moisture load;

wherein the moisture load information is determined in response to calculating a derivative of indoor humidity versus time.

8. The method of claim 7, wherein the moisture characteristics are calculated as time-series data based on an indoor humidity value, an outdoor humidity value, and moisture removal/addition capacity of an air conditioning system.

9. The method of claim 7, wherein the derivative is calculated according to the following Equation:

$$\frac{dW_{room}}{dt} = k1 * [W_{room} - W_{OA}] + k_2 * Cap + C;$$

wherein W=absolute moisture content; K1=air/moisture diffusion/leakage; C=internal latent loads; K2=de/humidification factor; Cap—de/humidification capacity of an air conditioning system.

10. The method of claim 9, wherein the processor is configured to compare a current value for moisture diffusion/air leakage to a historical value for moisture diffusion/air leakage;

determining a leak based at least in part on the comparison; and providing an indication of the leakage to a terminal device.

11. The method of claim 9, wherein the processor is configured to compare a current value for internal moisture loads to a historical value for internal moisture load;

determining abnormal internal moisture load based at least in part on the comparison; and providing an indication of the abnormal internal moisture load to a terminal device.

12. The method of claim 9, wherein the processor is configured to compare a current value of the humidification factor to a historical value for the humidification factor;

determining an abnormal humidification factor based at least in part on the comparison; and providing an indication of the abnormal humidification factor to a terminal device.

* * * * *